US007316225B2

(12) United States Patent
Murakami

(10) Patent No.: US 7,316,225 B2
(45) Date of Patent: Jan. 8, 2008

(54) FUEL VAPOR TREATMENT APPARATUS

(75) Inventor: Hiroyoshi Murakami, Obu (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/602,253

(22) Filed: Nov. 21, 2006

(65) Prior Publication Data

US 2007/0119427 A1 May 31, 2007

(30) Foreign Application Priority Data

Nov. 30, 2005 (JP) ..... 2005-345138

(51) Int. Cl.
*F02M 33/02* (2006.01)
*F02M 1/00* (2006.01)

(52) U.S. Cl. ..... 123/520; 123/516

(58) Field of Classification Search ..... 123/520, 123/516, 518, 519, 698
See application file for complete search history.

(56) References Cited

U.S. PATENT DOCUMENTS

| | | | | |
|---|---|---|---|---|
| 5,425,344 | A * | 6/1995 | Otsuka et al. | 123/520 |
| 6,892,712 | B2 * | 5/2005 | Miwa et al. | 123/520 |
| 6,971,375 | B2 * | 12/2005 | Amano et al. | 123/520 |
| 7,219,660 | B2 * | 5/2007 | Amano et al. | 123/520 |
| 2004/0250805 | A1 * | 12/2004 | Osanai | 123/698 |
| 2005/0211228 | A1 * | 9/2005 | Amano et al. | 123/520 |
| 2006/0031000 | A1 | 2/2006 | Amano et al. | |
| 2006/0042605 | A1 | 3/2006 | Amano et al. | |
| 2006/0086343 | A1 * | 4/2006 | Suzuki | 123/520 |
| 2007/0157908 | A1 * | 7/2007 | Kano et al. | 123/520 |

FOREIGN PATENT DOCUMENTS

| | | |
|---|---|---|
| JP | 05-018326 | 1/1993 |
| JP | 06-101534 | 4/1994 |

OTHER PUBLICATIONS

U.S. Appl. No. 11/583,089, filed Oct. 2006, Amano et al.

* cited by examiner

*Primary Examiner*—John T. Kwon
(74) *Attorney, Agent, or Firm*—Nixon & Vanderhye P.C.

(57) ABSTRACT

A fuel vapor treatment apparatus that includes a purge valve for controlling a quantity of fuel vapor purged from a canister. The apparatus also includes a controlling device that drives the purge valve based upon flow characteristic of the purge valve to a control amount for driving the purge valve to control a flow quantity of fluid flowing in the purge valve. The apparatus additionally includes a purge switching valve for switching communication of the purge valve between the canister and atmosphere. Furthermore, the apparatus includes a measuring device, which measures fluid pressure produced by opening the purge valve. The apparatus also includes a correcting device, which controls the purge switching valve and corrects the flow characteristic based upon pressure measured by the measuring device when the purge valve and the atmosphere communicate and based on the control amount in which the purge valve controlling device drives the purge valve.

9 Claims, 4 Drawing Sheets

FUEL VAPOR TREATMENT APPARATUS

CROSS-REFERENCE TO RELATED APPLICATION

This application is based on and claims priority to Japanese Patent Application No. 2005-345138, filed on Nov. 30, 2005, the disclosure of which is incorporated herein by reference.

FIELD

The present invention relates to a fuel vapor treatment apparatus that purges fuel vapor from a canister adsorbing the fuel vapor produced in a fuel tank into an intake passage.

BACKGROUND

There is conventionally known a fuel vapor treatment apparatus in which fuel vapor produced in a fuel tank is temporarily adsorbed in a canister. The fuel vapor is desorbed from the canister and is introduced and purged into an intake passage of an internal combustion engine. This type of fuel vapor treatment apparatus is disclosed, for example, in Japanese Patent Publication Nos. JP-A-5-18326 and JP-A-6-101534.

In such a fuel vapor treatment apparatus, an electric current is fed to a electromagnetic purge valve provided in the purge passage that is, for example, duty ratio-controlled, thereby adjusting a quantity of fuel vapor flowing through the purge valve. In addition, a flow quantity of purged fuel vapor and an injection quantity of fuel injected from a fuel injection valve are combined to realize a target air-fuel ratio in accordance with an engine operating condition.

However, as shown in FIG. 5, for the same duty ratio supplied to the purge valve, there can be variations in flow quantity of fuel vapor flowing in the purge valve due to variations in flow characteristic for each purge valve or variations in flow characteristic due to age. Accordingly, even if a flow quantity of the purge valve is controlled to obtain a target air-fuel ratio based upon the flow characteristic of the purge valve, the actual quantity of fuel vapor to be purged into the intake passage may differ from the target value. As a result, an actual air-fuel ratio in the internal combustion engine may deviate from the target air-fuel ratio.

Furthermore, where a fuel vapor treatment apparatus is applied to a low-pressure engine (i.e., where a negative pressure produced in the intake passage is reduced for less fuel consumption), the passage area of the purge valve is increased. However, increasing passage area of the purge valve causes increased variation of flow characteristic in each purge valve.

For eliminating such variation, manufacturing precision can be improved and/or a flow adjustment mechanism or the like can be added. However, these methods are limited. In a case of performing linear control of a purge valve, for example, where current value supplied to the purge valve and shift amount of the purge valve member are feedback-controlled, a shift sensor for detecting a shift amount of the valve member in the purge valve is needed, thus increasing costs.

Further, it is desirable to measure a flow quantity of fluid flowing in the purge valve to correct a flow characteristic of the purge valve. However, since the fluid flowing in the purge valve is a mixture of fuel vapor and air, even for the same duty ratio or current value, flow quantity of the fluid can vary with density of the fuel vapor or properties of the fuel. As a result, it is difficult to accurately correct the flow characteristic of the purge valve, and yet since a fuel vapor quantity out of a target value is purged until the flow characteristic is corrected, air-fuel ratio can deviate from the target value. Thus, there remains a need for a fuel vapor treatment apparatus that controls a quantity of fuel vapor to be purged regardless of variations in flow characteristic in each purge valve, with high accuracy, and inexpensively.

SUMMARY

A fuel vapor treatment apparatus is disclosed that includes a purge valve for controlling a quantity of fuel vapor purged from a canister into an intake passage of an engine. The apparatus also includes a purge valve controlling device, which drives the purge valve based upon a flow characteristic of the purge valve to a control amount for driving the purge valve to control a flow quantity of fluid flowing in the purge valve. The apparatus further includes a purge switching valve for switching communication of the purge valve between the canister and an atmosphere. Additionally, the apparatus includes a measuring device, which measures a pressure of fluid produced by opening the purge valve. Moreover, the apparatus includes a correcting device which controls switching of the purge switching valve and corrects the flow characteristic based upon the pressure measured by the measuring device when the purge switching valve allows communication between the purge valve and the atmosphere and based on the control amount in which the purge valve controlling device drives the purge valve.

BRIEF DESCRIPTION OF THE DRAWINGS

Other objects, features, and advantages will become more apparent from the following detailed description made with reference to the accompanying drawings, in which like portions are designated by like reference numbers and in which.

DETAILED DESCRIPTION OF EXAMPLE EMBODIMENTS

Figure 1:
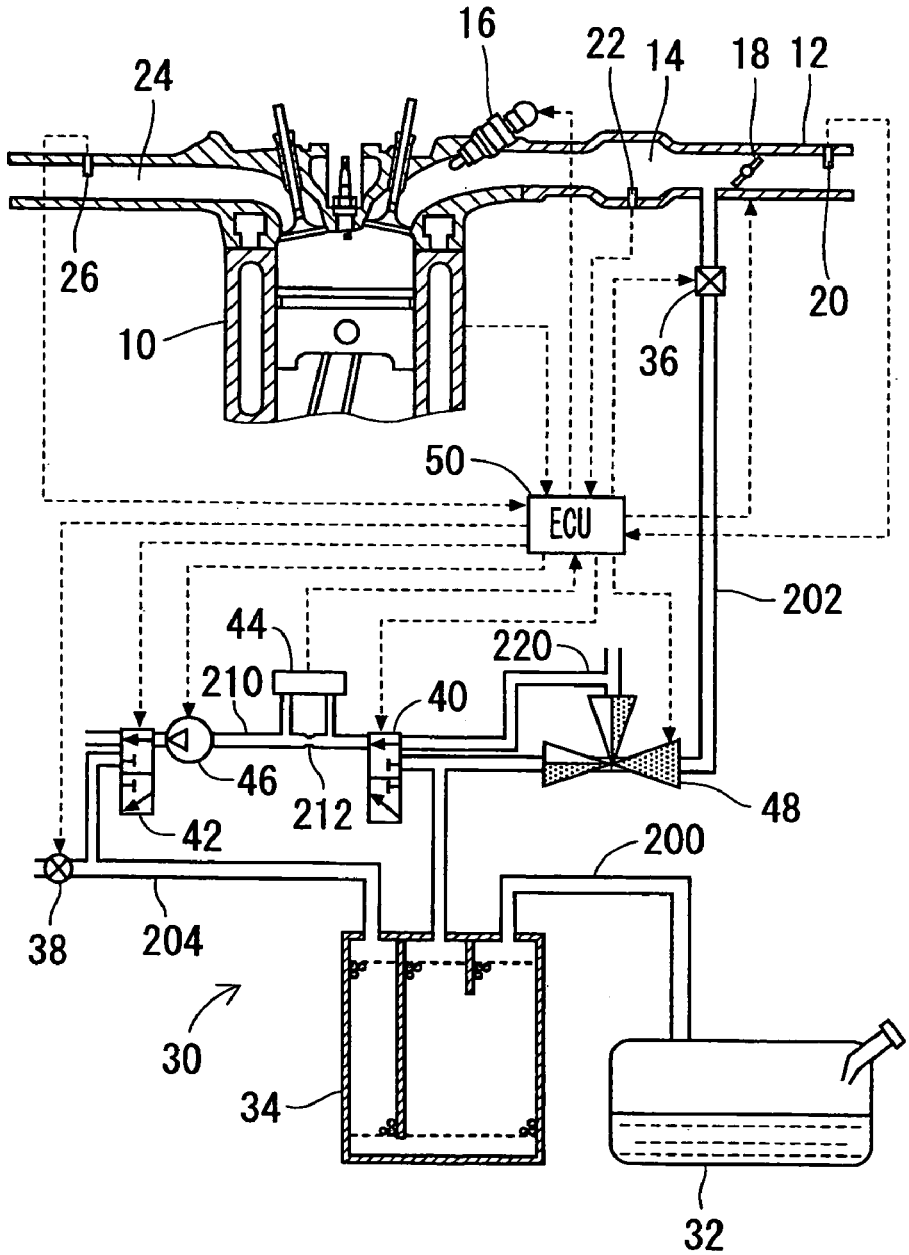
FIG. 1 is a schematic view of one embodiment of a fuel vapor treatment apparatus.

Referring initially, to FIG. 1, one embodiment of a fuel vapor treatment apparatus 30 is shown for a vehicle internal combustion engine 10. The engine 10 is a gasoline engine in which a gasoline received in a fuel tank 32 is burnt to produce power. A fuel injection valve 16 for controlling a fuel injection quantity, a throttle valve 18 for controlling an intake flow quantity, an air flow sensor 20 for detecting an intake flow quantity, an intake pressure sensor 22 for detecting an intake pressure and the like are installed in an intake passage 14 of an intake pipe 12 of the engine 10. In addition, an air-fuel ratio sensor 26 for detecting an air-fuel ratio and the like are installed in an exhaust passage 24.

The fuel vapor treatment apparatus 30 treats fuel vapor produced in the fuel tank 32 and supplies the treated fuel vapor to the engine 10. The fuel vapor treatment apparatus is provided with a canister 34, a purge valve 36, an atmosphere-opened valve 38, a plurality of switching valves 40, 42, 48, a differential pressure valve 44, a pump 46, an electronic control unit 50 (ECU), and the like. The ECU 50 controls a quantity of fuel vapor purged into the intake passage 14 from the canister 34 and also a fuel injection quantity from the fuel injection valve 16 in such a manner as to achieve a target air-fuel ratio determined in accordance with an engine operating condition. In this embodiment, the ECU 50 constitutes a purge valve controlling device, measuring device and correcting device.

The fuel tank 32 and the canister 34 are fluidly coupled through a passage 200. The fuel vapor produced in the fuel tank 32 passes through the passage 200 to the canister 34 and is adsorbed by an adsorbing material such as an active carbon in the canister 34. By opening the purge valve 36, the fuel vapor adsorbed in the canister 34 flows from the canister 34 through the purge passage 202 into the intake passage 14 downstream of the throttle valve 18 due to a negative pressure in the intake passage 14.

In one embodiment, the atmosphere-opened valve 38 is a two-way electromagnetic valve and is closed when power supply thereto is cutoff (i.e., an OFF state). When the atmosphere-opened valve 38 is opened, a passage 204 fluidly coupled to the canister 34 is opened to the atmosphere. When the purge valve 36 and the atmosphere-opened valve 38 are opened, the fuel vapor adsorbed in the canister 34 is purged through the purge passage 202 into the intake passage 14 downstream of the throttle valve 18 due to negative pressure in the intake passage 14.

In one embodiment, the switching valve 40 (i.e., a measuring switching valve) is a three-way electromagnetic valve for switching communication of the orifice 212 between an atmosphere side of the switching valve 48 and the purge passage 202 coupled to the canister 34. The switching valve 40 is shown in FIG. 1 in a switching state when power is cut off thereto (i.e., power OFF) such that the atmosphere side of the switching valve 48 is in communication with the orifice 212.

Furthermore, in one embodiment, the switching valve 42 is a three-way valve for switching communication of the pump 46 (i.e., a gas stream-producing device) between the atmosphere side or a passage 204 coupled to the canister 34. The switching valve 42 is shown in FIG. 1 in a switching state when power is cut off thereto (i.e., power OFF) such that an outlet of the pump 46 is open to the atmosphere. The pump 46 is used as pressure-reducing device and is structured so that an inlet and the outlet thereof are in communication when power is cut off thereto (i.e., power OFF).

The differential pressure sensor 44 (i.e., a pressure detecting device) is fluidly coupled to first and second opposite ends of the orifice 212 disposed in a measuring passage 210 between the pump 46 and the switching valve 40. The differential pressure sensor 44 detects a differential pressure between both first and second ends of the orifice 212.

When the switching valve 40 allows communication between the atmosphere side of the switching valve 48 and the orifice 212 during operation of the pump 46, the differential pressure sensor 44 detects an air pressure Pair as the differential pressure between both ends of the orifice 212 when only the air passes through the orifice 212. In addition, when the switching valve 40 allows communication between the purge passage 202 and the orifice 212 during operating of the pump 46, the differential pressure sensor 44 detects a mixture pressure Pgas as the differential pressure between the ends of the orifice 212 when a mixture of fuel vapor adsorbed in the canister 34 and air passes through the orifice 212.

It will be understood that the measuring passage 210, the orifice 212, the switching valve 40, the differential pressure sensor 44, the pump 46, and the ECU 50 constitute a measuring device.

In one embodiment, the switching valve 48 (i.e., a purge switching valve) is a three-way electromagnetic valve for switching communication of the purge valve 36 between the canister 34 and the passage 220 at the atmosphere side. Also, in one embodiment, when power is cut off to the switching valve 48, the switching state of the switching valve 48 allows communication between the purge valve 36 and the canister 34.

The ECU 50 controls operations of components such as the fuel injection valve 16 and the throttle valve 18 for the engine 10, based upon an ignition signal and detection signals such as an engine rotational speed, a cooling water temperature, and an accelerator position in addition to detection signals of the air flow sensor 20, the intake pressure sensor 22, and the air-fuel ratio sensor 26. Further, the ECU 50 controls operations of the purge valve 36, the atmosphere-opened valve 38, the switching valves 40, 42, 48, and the pump 46 and controls a quantity of fuel vapor to be purged into the intake passage 14. In one embodiment, data and programs processed in the ECU 50 are temporarily stored in RAM (not shown) of the ECU 50. Also, in one embodiment, ROM (not shown) of the ECU 50 is a rewritable, nonvolatile memory for storing control programs executed in the ECU 50 and uses an EEPROM or the like.

Figure 2:
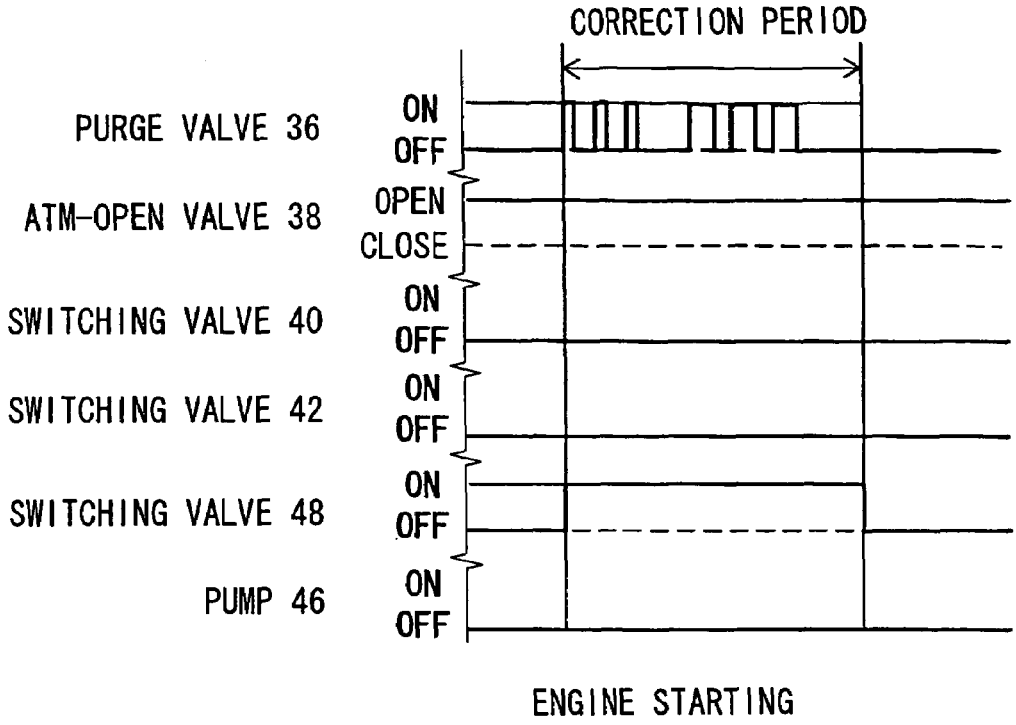
FIG. 2 is a time chart illustrating operating states of the fuel vapor treatment apparatus.
Figure 5:
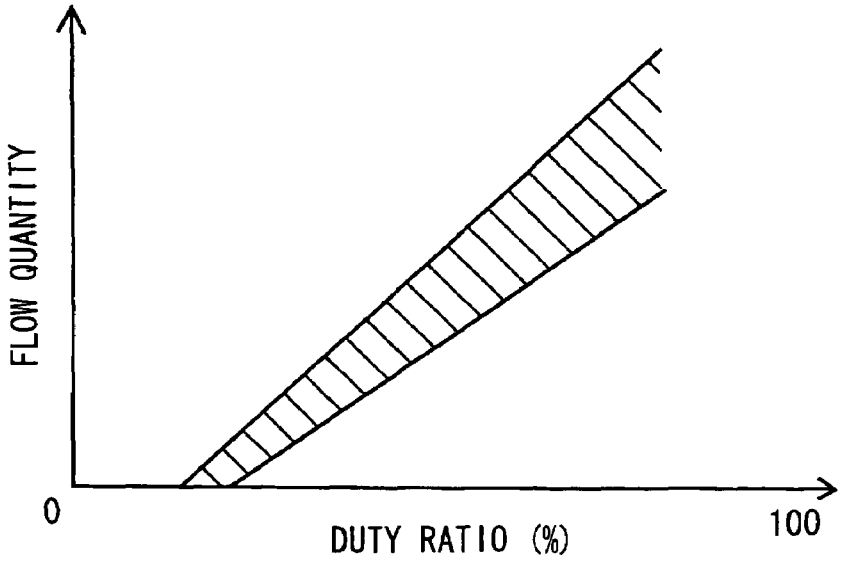
FIG. 5 is a characteristic graph showing a relation between a duty ratio of current supplied to a purge valve and a flow quantity thereof.
Figure 3:
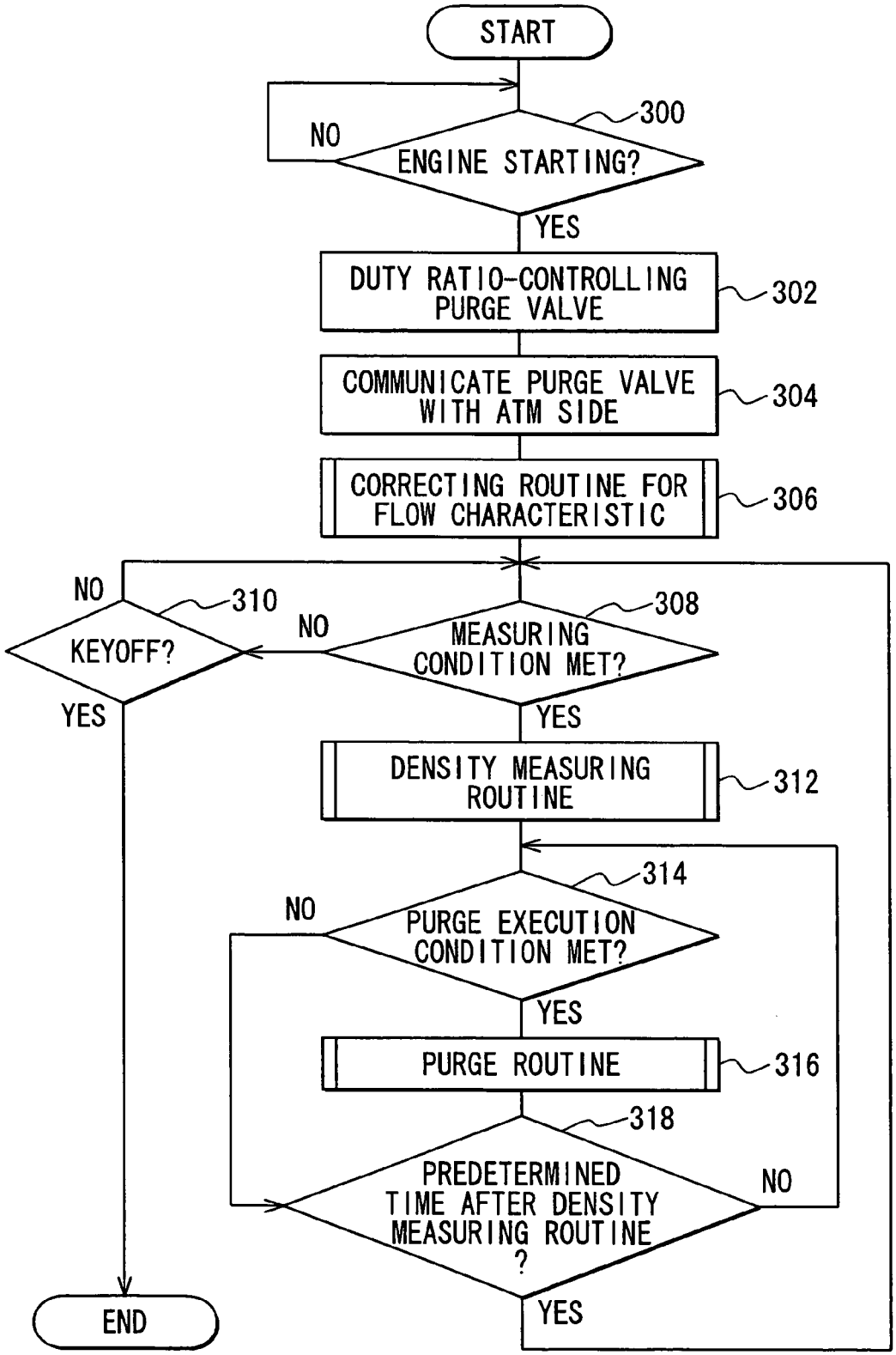
FIG. 3 is a flow chart illustrating one embodiment of a main routine of the fuel vapor treatment apparatus.

FIG. 3 shows a main routine where, after the flow characteristic of the purge valve 36 is corrected, the density of the fuel vapor is measured to determine a quantity of fuel vapor to be purged, based upon the measured density of the fuel vapor. The main routine is started by turning on the ignition key and carried out by executing the control programs stored in the ECU 50 by a CPU (not shown) of the ECU 50. At an initial state immediately after the engine is started (i.e., engine starting time), as shown FIG. 2, the power supply is cut off to the purge valve 36, the atmosphere-opened valve 38, the switching valves 40, 42, 48 and the pump 46. At this power OFF state, the purge valve 36 is closed, and the atmosphere-opened valve 38 is open. In addition, the switching valves 40, 42 are in switching states shown in FIG. 1, and the switching valve 48 is in a switching state allowing communication between the purge valve 36 and the canister 34.

As shown in FIG. 3, when the engine 10 is started at step 300 (i.e., engine starting time), the main routine proceeds to step 302. At step 302, the ECU 50 sets a duty ratio of the current supplied to the purge valve 36 to a predetermined value to thereby correct the flow characteristic of the purge valve 36. In one embodiment shown in FIG. 2, a relationship between the flow characteristic of the purge valve 36 and the duty ratio is stored as a map, and the duty ratio is sequentially changed between the duty ratio at which the purge valve 36 starts to open and the duty ratio at 100%. In another embodiment, the relationship between the flow characteristic of the purge valve 36 and the duty ratio is expressed as a function, and the predetermined value is set approximately equal to the duty ratio at which the purge valve 36 starts to open, determining a coefficient of the function for the flow characteristic.

Next, at step 304 the ECU 50 turns on the power supply to the switching valve 48 to allow communication between the purge valve 36 and the atmosphere side of the passage 220. As a result, air passes through the passage 220, then through the switching valve 48, and then through the purge valve 36. In addition, the switching valves 40 and 42 are in a state shown in FIG. 1, and power to the pump 46 is cut off such that the inlet and outlet of the pump are in communication. Therefore, the air is aspired from the passage 220 into the side of the purge valve 36, and as such, the air passes through the switching valve 42, then the pump 46, then the orifice 212, and then the switching valve 40, and is then aspired into the side of the purge valve 36. Accordingly, a differential pressure occurs between both ends of the orifice 212 due to passing of the air alone. This differential pressure is determined by a flow amount of the air flowing in the purge valve 36. The flow amount of the air flowing in the purge valve 36 is determined by a negative pressure in the intake passage 14 and a duty ratio of the current supplied to the purge valve 36. In other words, the flow characteristic of the purge valve 36 to the duty ratio of the current supplied to the purge valve 36 can be obtained by the differential pressure of the orifice 212 detected by the differential pressure sensor 44 and the negative pressure in the intake passage 14 detected by the intake pressure sensor 22.

Thus, in step 306 a correcting routine is performed for the flow characteristic of the purge valve 36 based upon the obtained flow characteristic of the purge valve 36 to the duty ratio of the current supplied to the purge valve 36. For instance, in one embodiment of step 306, the flow characteristic stored in ROM is corrected using the correcting routine.

More specifically, when the correction routine for the flow characteristic at step 306 is executed, the ECU 50 determines at step 308 whether or not a measuring condition for the density of the fuel vapor is met. In one embodiment for example, when the engine rotational speed is greater than a predetermined rotational speed and/or when the cooling water temperature is greater than a predetermined temperature, the ECU 50 determines that the measuring condition for the density is met. Furthermore, in one embodiment, the ECU 50 determines that the measuring condition for the density is met when the purging of the fuel vapor is stopped during operating of the engine, such as deceleration of the engine. Also, in one embodiment of a hybrid engine vehicle, it is determined that the measuring condition for the density is met when the engine 10 is stopped and a vehicle is running by a motor.

If the measuring condition is met (i.e., step 308 answered affirmatively), step 312 follows, and the density measuring routine is performed as will be described. However, if the measuring conditions for the density of the fuel vapor do not exist (i.e., step 308 answered negatively) the ECU 50 determines whether or not the ignition key is OFF in step 310. When the ignition key is OFF, the routine ends. When the ignition key is ON, the process goes back to step 308.

In the density measuring routine at step 312, the pump 46 is driven in a state shown in FIG. 1 and also the switching valves 40, 42 are controlled for switching. Thereby, there is detected an air pressure Pair as a differential pressure between both ends of the orifice 212 when only the air passes through the orifice 212 in a state where both sides of the orifice 212 are opened to the atmosphere. In addition, there is detected a mixture pressure Pgas as a differential pressure between both ends of the orifice 212 when a mixture of air and fuel vapor circulating through the canister 34, the orifice 212, and the canister 34 passes through the orifice 212. The ECU 50 measures the density of the fuel vapor contained in the mixture purged from the canister 34 into the intake passage 14, based upon Pgas/Pair.

Then, it is determined in step 314 whether the purge execution conditions are met. In one embodiment, purge execution conditions are met when a cooling water temperature reaches a temperature higher than a cooling water temperature when the measuring conditions for the density are met. Thus, in the embodiment shown, it is determined whether the measuring conditions for the density exist before it is determined whether the purge execution conditions exist.

Thus, after the density for the fuel vapor is measured in the density measuring routine at step 312, the ECU 50 determines at step 314 whether or not purge execution conditions are met. When the purge execution condition is met, the ECU 50 executes a purge routine at step 316. In the purge routine at step 316, the ECU 50 controls a duty ratio of the current supplied to the purge valve 36 based upon the measured density for the fuel vapor and the flow characteristic of the purge valve 36 corrected at step 306. Thereby, the ECU 50 determines a quantity of fuel vapor to be purged from the purge valve 36 into the intake passage 14.

After the ECU 50 commences the purge routine at step 316, the ECU 50 determines at step 318 whether a predetermined time has elapsed since the density measuring routine was executed. If the predetermined time has elapsed, the quantity of the fuel vapor adsorbed in the canister 34 may have changed, thus changing the density of the fuel vapor. Therefore, if the predetermined time has elapsed (i.e., step 318 answered affirmatively), the ECU 50 returns the process back to step 308 and at step 312, the density measuring routine is again executed. The predetermined time of step 318 is set according to a desired accuracy of density for the fuel vapor in consideration of a change of the density for the fuel vapor over time. In a case the predetermined time has not elapsed after the density measuring routine was executed (i.e., step 318 answered negatively), the ECU 50 returns the process back to step 314.

In a case the purge execution condition is not met at step 314, the ECU 50 advances the process to step 318, wherein the ECU 50 determines whether or not the predetermined time has elapsed since the density measuring routine was executed.

In the embodiment described above, the orifice 212 for measuring the density for the fuel vapor is used to detect a differential pressure in the atmosphere side of the purge valve 36 for correcting the flow characteristic of the purge valve 36. Therefore, for correcting the flow characteristic of the purge valve 36, only an addition of the switching valve 48 and a modification of a part of passage structures may be necessary. As a result, the apparatus can include relatively few components and/or modification of existing components.

Figure 4:
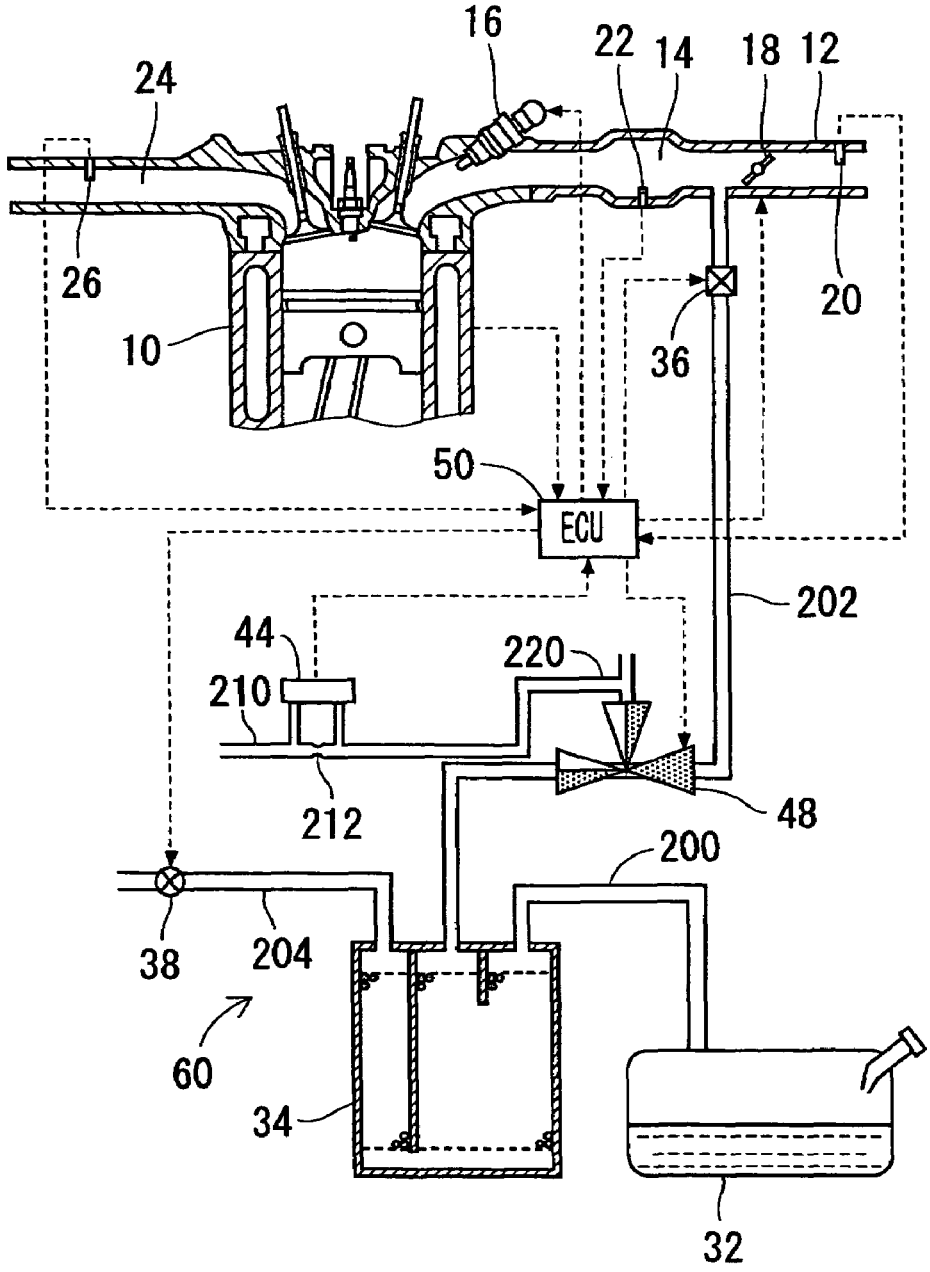
FIG. 4 is a schematic view of another embodiment of a fuel vapor treatment apparatus.

Referring now to FIG. 4, another embodiment of a fuel vapor treatment apparatus 60 is illustrated. It should be noted that components in this embodiment that are similar to those of the embodiment described above are indicated with identical numerals.

Comparing the embodiment of FIG. 4 to the embodiment FIG. 1, the switching valves 40, 42 for measuring the density for the fuel vapor, the pump 46 and the passage of the embodiment of FIG. 1 are not included in the embodiment of FIG. 4. Also, the measuring passage 210 is directly in communication with the passage 220.

In the embodiment of FIG. 4, when power is supplied to the switching valve 48 to allow communication between the purge valve 36 and the passage 220 in the side of the atmosphere, air passes through the orifice 212, then the passage 220, then the switching valve 48, and then the purge valve 36 due to the negative pressure in the intake passage 14. Accordingly, a differential pressure occurs between both ends of the orifice 212 due to the passing air alone. In other words, the flow characteristic of the purge valve 36 to the duty ratio of the current supplied to the purge valve 36 can be obtained by the differential pressure of the orifice 212 detected by the differential pressure sensor 44 and the negative pressure in the intake passage 14 detected by the intake pressure sensor 22 to correct the flow characteristic of the purge valve 36.

Each of the embodiments as described above is formed with a simple structure where the communication of the purge valve 36 with either the atmosphere or the canister is switched by the switching valve 48 using a known three-way electromagnetic valve. In such a simple structure, a negative pressure in the intake passage 14 is used to measure a flow quantity of fluid flowing in the purge valve 36 when only air flows through the purge valve 36, thereby correcting the flow characteristic of the purge valve 36 to a duty ratio of the current supplied to the purge valve 36. Thereby, it is possible to accurately correct variations in the flow characteristic for each purge valve 36 with a simple structure regardless of the density of the fuel vapor to be purged into the intake passage 14 and regardless of the fuel properties. Accordingly, an actual air-fuel ratio can be adjusted in close proximity to the target air-fuel ratio from a quantity of fuel vapor purged from the purge valve 36 and an injection quantity of fuel injected from the fuel injection valve, based upon the corrected flow characteristic.

Accordingly, the fuel vapor treatment apparatus is particularly useful in connection with a purge valve having a large flow amount, for a low-pressure engine, and where flow characteristic for each purge valve largely varies.

In addition, in the embodiment described above, correction processing for the flow characteristic of the purge valve 36 is executed during engine starting (i.e., immediately after the engine is started). Thus, the correction processing can be performed when purging is stopped. As such, the correction processing can be performed without interrupting the purge processing.

Further, in one embodiment, the correction processing of the flow characteristic of the purge valve 36 is executed each time immediately after the engine 10 is started. Thus, even if the flow characteristic of the purge valve 36 varies due to changes of the purge valve 36, pipes or the like with age, the variation of the flow characteristic due to the change with age can be corrected.

Moreover, in the embodiment described above, the correction processing of the flow characteristic of the purge valve 36 is executed before the purge processing starts. Thus, even if the purge valve 36 is inoperable due to the defect of the purge valve 36, a failure of the purge valve 36 can be detected before the purge processing.

In addition, a quantity of fuel vapor purged from the purge valve 36 can be controlled with a high accuracy by correcting the flow characteristic. As such, a less expensive purge valve can be used.

In the embodiments as described above, the purge valve 36 is duty ratio-controlled. However, it will be appreciated that a purge valve for linear control may be used to correct the flow characteristic of the purge valve to a current value supplied to the purge valve.

In the embodiments described above, the orifice 212 is used to detect a pressure of air flowing in the atmosphere side of the purge valve 36, correcting the flow characteristic of the purge valve 36. However, it will be appreciated that a flow quantity of air flowing in the atmosphere side of the purge valve 36 may be detected to correct the flow characteristic of the purge valve 36.

In addition, in a case of correcting the flow characteristic of the purge valve 36, there may be detected a pressure or a flow quantity of air in any location of a path that includes the switching valve 48, the purge valve 36, or the intake passage 14 from the atmosphere side where the air flows, thereby correcting the flow characteristic to the duty ratio of the current supplied to the purge valve 36.

In addition, a flow quantity of fluid flowing in the purge valve 36 to the duty ratio of the current supplied to the purge valve 36 is obtained based upon the differential pressure between the both ends of the orifice 212 and the negative pressure in the intake passage 14. However, the negative pressure in the intake passage 14 immediately after the engine is started may be set as a prescribed value, obtaining a quantity of fluid flowing in the purge valve 36 to a duty ratio of the current supplied to the purge valve 36 from the differential pressure between the both ends of the orifice 212 without detecting the negative pressure in the intake passage 14.

Further, in place of the differential pressure sensor 44, a relative pressure sensor or an absolute pressure sensor may be used as a pressure detecting device to measure a pressure in the measuring passage 210.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A fuel vapor treatment apparatus comprising:

a purge valve for controlling a quantity of fuel vapor purged from a canister into an intake passage of an engine;

a purge valve controlling device which drives the purge valve based upon a flow characteristic of the purge valve to a control amount for driving the purge valve to control a flow quantity of fluid flowing in the purge valve;

a purge switching valve for switching communication of the purge valve between the canister and an atmosphere;

a measuring device which measures a pressure of fluid produced by opening the purge valve; and a correcting device which controls switching of the purge switching valve and corrects the flow characteristic based upon the pressure measured by the measuring device when the purge switching valve allows communication between the purge valve and the atmosphere and based on the control amount in which the purge valve controlling device drives the purge valve.

2. A fuel vapor treatment apparatus according to claim 1, wherein the correction device controls the purge switching valve to allow communication between the purge valve and the atmosphere during a starting time of the engine, and corrects the flow characteristic based upon the pressure measured by the measuring device and based on the control amount in which the purge valve controlling device drives the purge valve.

3. A fuel vapor treatment apparatus according to claim 1, wherein the measuring device comprises:

a measuring passage including an orifice; and a pressure detecting device operatively coupled to the measuring passage;

wherein the measuring passage is coupled with the atmosphere; and when the purge switching valve allows communication between the purge valve and the atmosphere, the correcting device corrects the flow characteristic based upon the pressure measured by the measuring device and the control amount in which the purge valve controlling device drives the purge valve.

4. A fuel vapor treatment apparatus according to claim 3, wherein the pressure detecting device includes a relative pressure sensor installed between the orifice and the purge switching valve.

5. A fuel vapor treatment apparatus according to claim 3, wherein the pressure detecting device includes an absolute pressure sensor installed between the orifice and the purge switching valve.

6. A fuel vapor treatment apparatus according to claim 3, wherein the orifice includes a first and a second end, and wherein the pressure detecting device includes a differential pressure sensor for detecting a differential pressure between the first and second ends of the orifice.

7. A fuel vapor treatment apparatus according to claim 3, wherein the measuring device further comprises:

a measuring switching valve operatively coupled to the measuring passage so as to be interposed between the purge valve and the orifice, the measuring switching valve for switching communication of the orifice between the atmosphere and the canister; and a gas stream-generating device operatively coupled through the orifice to the measuring switching valve, wherein the gas stream-generating device is operatively coupled to the measuring passage on a side of the orifice opposite to that of the measuring switching valve; and wherein the purge valve controlling device adjusts a purge amount of the fluid purged into the intake passage based upon pressure detected by the pressure detecting device when the gas stream-generating device is activated and the measuring switching valve allows communication between the orifice and the atmosphere, and based on pressure of a mixture of air and fuel vapor detected by the pressure detecting device when the measuring switching valve allows communication between the orifice and the canister while the purging of the fuel vapor from the canister into the intake passage is stopped.

8. A fuel vapor treatment apparatus according to claim 1, wherein when the purge switching valve allows communication between the purge valve and the atmosphere, the correcting device corrects the flow characteristic based upon the pressure measured by the measuring device, the control amount in which the purge valve controlling device drives the purge valve, and a pressure in the intake passage.

9. A fuel vapor treatment apparatus according to claim 1, wherein at least one of the purge valve and the purge switching valve is an electromagnetic valve.

* * * * *